US005227639A

United States Patent [19]

Sigafus

[11] Patent Number: 5,227,639

[45] Date of Patent: Jul. 13, 1993

[54] INFRARED-BASED SENSING CIRCUIT PROVIDING AN OUTPUT SIMULATING THE OUTPUT OF A FLAME ROD SENSOR

[75] Inventor: Paul E. Sigafus, Medina, Minn.

[73] Assignee: Honeywell Inc., Minneapolis, Minn.

[21] Appl. No.: 957,460

[22] Filed: Oct. 6, 1992

Related U.S. Application Data

[63] Continuation of Ser. No. 808,382, Dec. 16, 1991, abandoned.

[51] Int. Cl.[5] ..... G01J 31/14

[52] U.S. Cl. ..... 250/554; 250/214 R; 307/261

[58] Field of Search ..... 250/554, 214 R; 431/46, 431/78, 80; 307/261, 262, 359

[56] References Cited

U.S. PATENT DOCUMENTS

| | | | |
|---|---|---|---|
| 3,710,149 | 1/1973 | Thomson | 250/534 |
| 3,755,799 | 8/1973 | Riccardi | 340/228 |
| 3,903,418 | 9/1975 | Horn | 250/338 |
| 4,328,527 | 5/1982 | Landis | 361/175 |
| 4,616,138 | 10/1986 | Yuchi | 250/554 |
| 4,847,620 | 7/1989 | Trafimenkoff et al. | 307/261 |
| 4,904,986 | 2/1990 | Pinckaers | 340/578 |
| 5,073,769 | 12/1991 | Kompelien | 250/554 |

*Primary Examiner*—David C. Nelms
*Assistant Examiner*—T. Davenport
*Attorney, Agent, or Firm*—Edward Schwarz

[57] ABSTRACT

A converter circuit provides an output signal of polarity opposite that of an input signal having a DC component and a low frequency periodic component in response to presence of that input signal. Current is transferred from a first capacitor to a second to accomplish this conversion. The circuit has particular application in a flame sensing interface circuit using a sensor of the infrared radiation generated by the flame to change the impedance of the sensor. By use of the circuit, the output of an infrared sensing amplifier imitates the output of a conventional flame rod sensor, and provides an output signal compatible with the output of a flame rod to the input to a flame signal processor.

20 Claims, 2 Drawing Sheets

INFRARED-BASED SENSING CIRCUIT PROVIDING AN OUTPUT SIMULATING THE OUTPUT OF A FLAME ROD SENSOR

This application is a continuation of application Ser. No. 07/808,382, filed Dec. 16, 1991, now abandoned.

BACKGROUND OF THE INVENTION

State of the art controllers for fuel burners such as furnaces are now based on microprocessors which dramatically improve the control process. Nevertheless, it is still necessary to provide information as to the current operating state of the fuel burner. Among the most important of the state parameters is whether there is flame actually consuming the fuel being provided to the burner. The continued supply of fuel to the burner must be conditioned on the presence of flame, since if flame is not present and fuel is allowed to flow to the burner, the accumulation resulting can explode or asphyxiate, either one a potentially lethal event. Accordingly, it has been recognized for a long time in burner control technology that detection of flame is of paramount importance.

There are basically three kinds of flame detector elements. Perhaps the simplest is the so-called flame rod, which is simply a metal element insulated from the burner metal and located within the ionized particles forming the flame, and which forms with the burner metal a sort of diode element when flame is present. The diode action arises from the difference in the size of the flame rod compared to the burner itself. An AC potential applied between the flame rod and the burner metal causes DC current to be carried by the ionized particles generated by presence of a flame. By detecting presence of this DC current flow, it is possible to determine presence of flame. Because of the difference in sizes of the flame rod and the burner, the current flow is from the flame rod to the burner, meaning that presence of flame is signified by current flow into the flame rod signal conductor, placing its potential below ground voltage as represented by the burner.

A second type of flame detector circuit uses a phototube sensitive to ultraviolet radiation, and which produces a characteristic change in impedance indicating flame when such radiation is present. U.S. Pat. No. 5,194,728, patented on Mar. 16, 1993 by Scott Peterson, entitled "Fail-Safe UV Amplifier that is Compatible with Flame Current Digitizer Circuit", and having a common assignee with this application, uses the special characteristic of the ultraviolet-sensitive phototube to discriminate between actual presence of ultraviolet radiation and other causes of change in phototube impedance. The circuit of this application is noteworthy for the reason that it produces an output which simulates the output signal of the conventional flame rod sensor.

A third type, and the one with which the invention to be described deals, produces an output when infrared radiation produced by a flame impinges on an cadmium sulfide or other type of detector tube whose impedance drops in response to the radiation. Each of these sensors produces an output requiring substantial processing by special circuitry before a signal indicating presence and absence of flame and which is suitable to be an input to a microprocessor is generated. The circuitry which converts the flame detector signal to a signal suitable for use by the controller is referred to as a flame amplifier and its output as a flame present signal, or more simply, a flame signal In the case of infrared sensing, the characteristic of the signal which reliably indicates flame is known to be the presence of a 5 to 15 hz. flicker. This flicker is a natural result of combustion of the hydrocarbon fuels in common use, and many infrared sensor circuits use this flicker as a basis for indicating presence of flame. The flicker is only one component of the total infrared radiation output of the flame however, and a minor one at that, so those infrared sensor circuits relying on the flame flicker to distinguish between presence and absence of flame must carefully separate the flicker component of the infrared sensor from what is noise for the purposes of flame detection.

A flame rod amplifier circuit designed to operate with a positive DC power supply adds a measure of reliability to its operation by interfacing with a flame rod sensor whose output is a negative current, i.e., one whose current flows into the sensor from the flame amplifier. The extra measure of reliability arises from the fact that any leakage current within the flame amplifier cannot masquerade as the negative current flow forming the flame rod output. Any leakage current in a flame amplifier powered by positive voltage will almost invariably be positive, and thus not likely to be interpreted as the negative flame rod sensor output. A pending US patent application which covers a flame amplifier circuit embodying these concepts is titled Fail-Safe Condition Sensing Circuit, was filed on Oct. 28, 1991 with Ser. No. 07/783,950, and has a common inventor and assignee with this application.

The most efficient way to implement this flame rod amplifier is as a special purpose microcircuit. Because of this implementation, returns to scale are particularly high, meaning that the unit cost drops substantially with increases in the number of individual circuits produced. Accordingly, it is very advantageous for this flame rod amplifier to be compatible with not only the flame rod detector, but also with the UV and IR detectors. However, the power required to drive the UV and IR detectors is different from that required for flame rod detectors, and the output signal of each has substantially different characteristics from the other two. Accordingly, it is not possible to simply replace the flame rod detector with either a UV tube or infrared cell flame detector. Instead, the interface circuit described above for the UV tube, or the interface circuit of which the invention to be described forms a part, is necessary to provide a signal output compatible with a detector intended for use with a flame rod detector.

There are any number of circuits now known which are intended to detect presence of flame by sensing presence of the 5–15 hz. frequency component in the infrared spectrum. For example, recently issued U.S. Pat. No. 5,073,769 discloses apparatus for detecting indicative of flame by us of the discrete Fourier transform.

BRIEF DESCRIPTION OF THE INVENTION

The embodiment of the invention to be described has the ability to interface the above-described flame rod amplifier to the standard infrared flame detector cell. This interface circuit depends on the presence of the flicker component of the infrared radiation to provide a flame detector signal indicating that flame is present. The signal directly produced by the infrared detector cell is processed by conventional circuitry including active filters to finally provide a signal approximating a sine wave when flame is actually present. The part of this interface circuit which forms the subject of this application receives this approximate sine wave signal and uses it as the basis for generating a signal nearly identical to the signal provided by the flame rod detector when flame is present.

To operate compatibly with the amplifier or processor for a flame rod detector, it is necessary for the infrared detector circuit to produce a signal which simulates the flame rod output. At the same time for absolute safety in operation, it is necessary for the circuit to operate on power whose polarity is opposite the polarity of the simulated flame rod signal which the circuit must provide. A circuit which provides such an output current signal of a first polarity is generally intended to operate with a low frequency input signal varying between first and second voltage limit values each of a second polarity different from the first polarity. In the context of infrared sensor-based flame detection here, the input signal has an approximate sine wave shape. The circuit is powered by a DC source whose voltage is of the same polarity a the voltage limit values and is thus of polarity different from that required for the output signal.

This invention has a half wave and a full wave embodiment. The half wave embodiment is much less likely to be used in an actual application but is included as an aid to understanding the invention and for completeness. Both embodiments of this invention comprise a converter circuit providing an output signal of a first polarity responsive to a periodic low frequency input signal varying between two voltage limit values of a second polarity different from the first polarity and having at least a predetermined amplitude. The input signal thus has a substantial DC component on which the periodic component is superimposed.

The half wave embodiment of the converter circuit includes a first capacitor whose first of two terminals is connected to receive the input signal. A first resistor connects a second of the first capacitor's two terminals to ground. A diode circuit comprising a diode and a second resistor in series connection has a first of its two terminals connected to the second terminal of the first capacitor with the diode in the diode circuit oriented for back biasing by the input signal. A second capacitor is connected between ground and a second terminal of the diode circuit and provides the output signal at the second terminal of the diode circuit. A resistive path is connected to discharge the second capacitor over a period of several input signal cycle times, and may comprise either a third resistor connected across the second capacitor, or a third resistor in parallel with the diode.

As the input signal voltage varies between the two voltage limit values, the first capacitor quickly charges to near the voltage of the input signal's DC component. The swings of the input signal which cause the voltage at the common connection point for the diode circuit, the first capacitor and the first resistor to cross 0 v. then forward bias the diode, and the second capacitor charges through the resistor of the diode circuit to a polarity different from that of the input signal. It can thus be seen that this circuit makes it possible to produce an output signal which indicates presence of the input signal with a voltage on the second capacitor of polarity different from the polarity of the input signal. The resistive path allows the second capacitor to quickly discharge whenever the periodic component of the input signal disappears. Thus, any current leakage within the circuitry involved with producing the input signal, to the circuit of interest here, will not simulate the input signal and cause presence of the output signal of opposite polarity. Accordingly, this circuit is suitable for applications where high reliability is important, such as the aforementioned flame signal processing.

The converter circuit of the preferred embodiment operates in a full wave configuration in a manner very similar to the simplified half wave circuit configuration described above. As with the simplified circuit, the full wave converter circuit also provides an output signal of a first polarity responsive to a periodic low frequency input signal varying between two voltage limit values of a second polarity different from the first polarity. This circuit comprises a first capacitor having a first of two terminals connected to receive the input signal. An inverting amplifier also receives the input signal and providing a signal varying between the two voltage limit values, and inverted with respect to the input signal. By inverted in this context is meant that the inverted signal's voltage at any instant equals twice the voltage of the DC component in the input signal less the value of the DC voltage component at that instant. More simply, the inverted signal mirrors the input signal about the DC component voltage level. Both the input signal and the inverted signal have identical DC components. A second capacitor has a first of its two terminals connected to receive the inverting amplifier output. First and second resistors connect second terminals of the first and second capacitors respectively to ground. First and second diodes have their first terminals connected together and their second terminals connected respectively to the second terminals of the first and second capacitors. These diodes are oriented so that they are back biased by the input signal and the inverted signal. A third resistor has the first of its two terminals connected to the first and second diodes' first terminals. A third capacitor is connected between ground and a second terminal of the third resistor and provides the current signal at the third resistor's second terminal. A resistive path is connected to discharge the third capacitor.

As the input signal varies between the two voltage limit values, the first and second capacitors both charge to the DC component voltage. As the voltages at their second terminals are driven below 0 v. on succeeding half cycles, the diode connected to receive the signal is placed in conduction, and part of the charge on the first or second capacitor is transferred to the third capacitor, but with the opposite polarity. In this way the third capacitor is charged to a polarity opposite that of the voltage limit value when the low frequency periodic input signal with a DC component is present. Should the input signal not vary within the specified range, the charge on the third capacitor drops substantially. This circuit is also suitable for critical safety applications such as indicating that flame is or is not present. Because of the full wave characteristics by which the third capacitor is charged, the indication is made with greater precision and reliability.

Accordingly, one object of the invention is to provide a signal of one polarity when a periodic signal varying between voltage limits of the opposite polarity is present.

A second object of the invention is to provide a means of conforming the signal provided by a flame detector sensitive to infrared radiation, to a flame rod signal.

Another object of the invention is so far as is now known to be possible, to immunize the circuit which processes a signal, from leakage or other malfunctions which might simulate its presence.

Other objects and purposes of the invention will become apparent from the descriptive matter following.

DESCRIPTION OF THE PREFERRED EMBODIMENT

Figure 1:
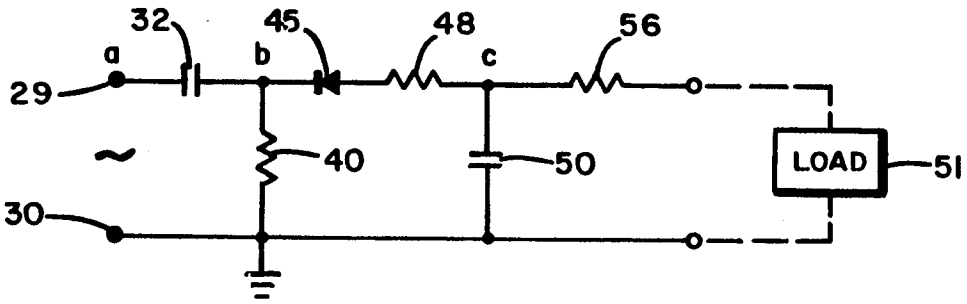
FIGS. 1 and 2 are circuit diagrams of two similar simplified embodiments of the invention.

The converter circuit of FIG. 1 (and the very similar FIG. 2) is a simplified embodiment of the invention and not now considered to be the preferred embodiment. It is included for the purpose of disclosing the structure and operating principles of the invention. Since this circuit functions in a half wave mode, its resolution is lower than the operational circuit of FIG. 4 and there is a more pronounced ripple in the output signal. However, in certain applications, this circuit will function adequately.

Figure 3:
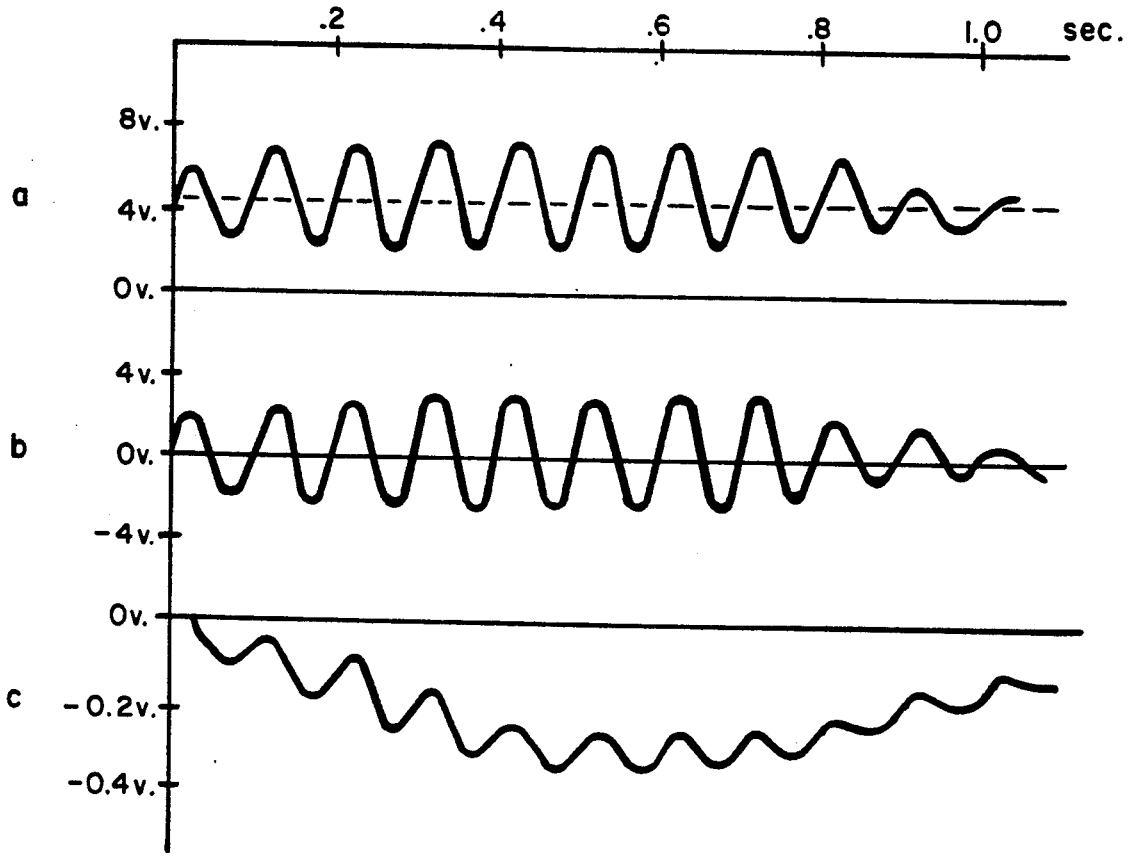
FIG. 3 shows waveforms helpful in understanding the operation of the circuits shown in FIGS. 1 and 2.
Figure 2:
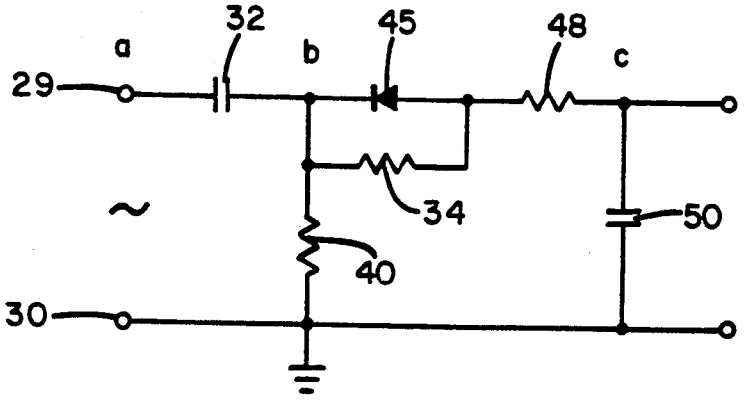

Waveforms helpful in understanding the circuits of FIGS. 1 and 2 are shown in FIG. 3. The letters designating individual waveforms display the signal at the similarly designated signal paths in FIGS. 1 and 2. In FIGS. 1 and 2, a sine wave input signal shown as waveform a in FIG. 3 is applied to input terminals 29 and 30. The input signal applied to is typical of that provided to the preferred circuit and has a DC component of around +4.35 v. and peak excursions falling between positive voltage limit values of approximately 2 v. and 6.5 v. With the voltage of the input signal thus always positive, it can considered to be of a single polarity. Input terminal 30 forms the ground for the circuit, with respect to which all voltages are referenced.

A capacitor 32 is connected by a first of its two terminals to input terminal 29. The second terminal of capacitor 32 is connected at point b in FIGS. 1 and 2 to input terminal 29 (ground) through a charging resistor 40. The second terminal of capacitor 32 is also connected to a first terminal of a diode circuit comprising a signal diode 45 in series with a signal resistor 48. Diode 45 is oriented with its cathode connected to the second terminal of capacitor 32 so that the positive polarity of the input signal back biases the diode. A second terminal of the diode circuit is connected to a first terminal of an output signal capacitor 50, whose second terminal is connected to ground.

The capacitor 32 quickly charges to the DC component voltage level through resistor 40 with point b relatively negative with respect to point a. During the relatively positive half cycles of the input signal, point b will still be positive as is shown in waveform b of FIG. 3. However, after this charging is complete, at around 0.2 sec. as shown in waveforms a and b, then during the relatively negative half cycles of the input signal, point b is driven by the voltage across capacitor 32 to approximately −2.0 v. The level of −2.0 v. arises mainly from the displacement of the input signal voltage below the DC component voltage level. This negative voltage at point b forward biases diode 45, allowing current to flow through the diode circuit from capacitor 50 and into capacitor 32, in effect transferring charge from capacitor 32 to capacitor 50. The charge transferred, however, negatively charges capacitor 50 and causes point c to become negative with respect to ground. This negative charge on capacitor 50 provides the output signal of opposite polarity which results from the presence of the specified input signal. As the amplitude of the low frequency component in the input signal drops in the interval from 0.7 sec. to 1.0 sec. as is shown in waveform a, the voltage across capacitor 50 becomes correspondingly smaller, as is shown by the rise in voltage of waveform c after 0.7 sec. This reduction in the voltage of waveform c arises because there is constant discharge of capacitor 50 through resistor 56 and load 51 on the one hand, and no charge transfer from capacitor 32 to capacitor 50 on the other, this latter because of the reduced peak to peak voltage beginning at 0.7 sec. for the waveforms shown. That is, when the amplitude of the input signal's periodic component nears 0 v., the voltage across capacitor 50 also nears 0 v. because of discharge through the resistive path comprising in FIG. 1 resistor 56 and a load 51.

The circuit of FIG. 1 may be configured to provide either a current or a voltage output signal. If the impedance of load 51 is very high compared to the value of resistor 56, then the level of the voltage across load 51 provides the output signal. If load 51 has very low impedance then the output signal is provided by the current level through load 51.

In FIG. 2, the resistive path for discharging capacitor 50 is formed by resistors 40 and 48 and by resistor 34 connected across diode 45. In this embodiment, the output signal is considered to be the voltage across capacitor 50. In both FIGS. 1 and 2, the voltage at point c is below ground and the voltage signal is negative when indicating presence of the input signal. In FIG. 1, when load 51 is of low impedance and the current level defines the signal, current flow into point c represents a polarity of the signal in waveform c different from that of the input signal. It can thus be seen that the circuit of FIGS. 1 and 2 is admirably suited for processing a flame signal represented by the periodic component of the input signal without providing an output signal falsely indicating presence of the periodic component.

Figure 4:
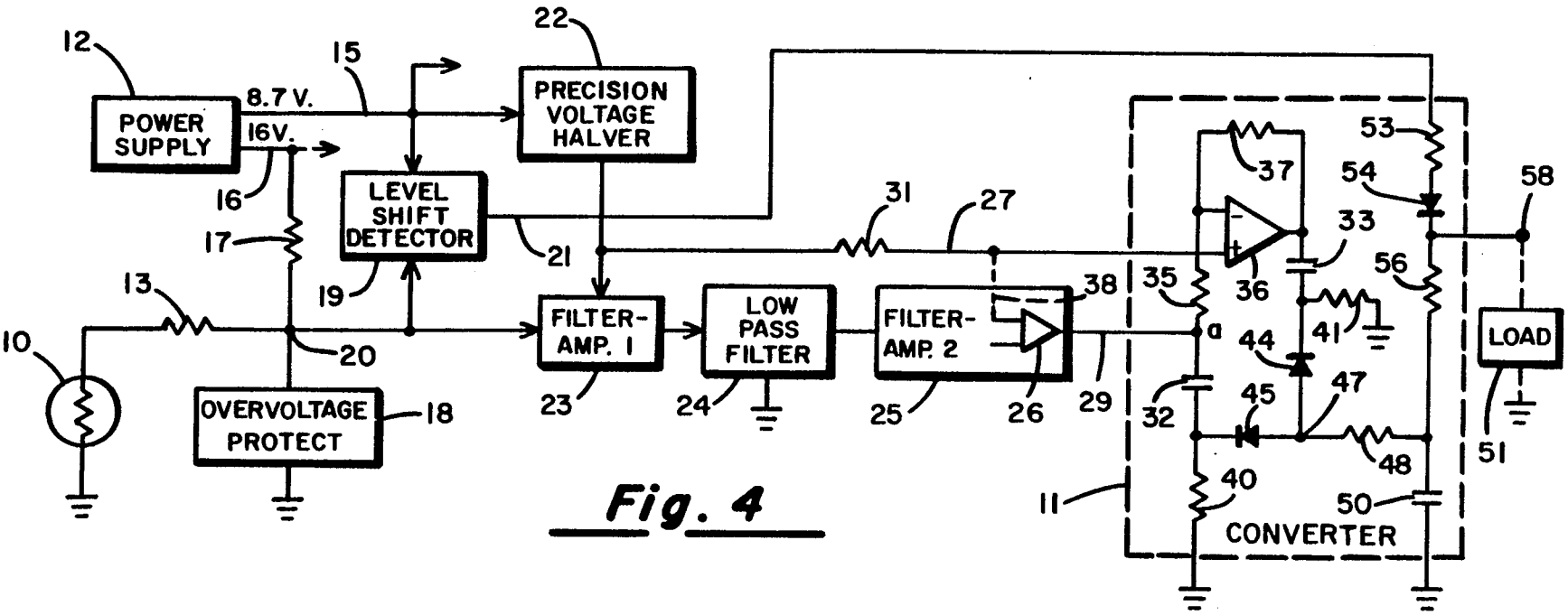
FIG. 4 is a circuit diagram of a preferred embodiment of the invention, part of which is shown in block form, with individual components shown for the part of the circuit involving the invention.

The preferred circuit of FIG. 4 is shown in the context of the complete circuit for processing a signal formed by the infrared radiation from a conventional burner flame. An infrared detector cell 10 is placed in proximity to the flame to be detected In these types of cells, resistance is inversely related to the level of impinging infrared illumination. In one type of these cells, dark resistance is approximately 1.2 MΩ and falls to 0.6 MΩ when intense infrared radiation impinges on the cell. The response of a typical cell 10 to changes in the intensity of impinging infrared radiation is at least in the microsecond range, so the dynamic resistance changes accurately reflect the actual changes in infrared radiation intensity.

In the circuit of FIG. 4, a power supply provides output voltages of 8.7 v. and 16 v. on conductors 15 and 16 respectively. Resistors 13 and 17 form a voltage divider circuit with infrared cell 10 between the 16 v. output of power supply 12 and ground. As the resistance of cell 10 varies, the voltage at point 20 also varies, providing the infrared cell signal to the circuit. An overvoltage protection circuit 18 prevents static discharges from damaging the inputs of delicate amplifiers in the signal processing elements.

If for some reason flame vanishes completely over a very short period of time, the resistance of cell 10 will rise rapidly, and the voltage at point 20 will also rise rapidly. Level shift detector 19 senses any rapid rise in the voltage at point 20 and provides a relatively high positive voltage on its output path 21.

More normally, the voltage signal at point 20 will be produced both by changes in the impedance of cell 10 arising from the changes in the level of infrared radiation falling on the cell, and by other effects, all of which combine during and for a period of time after flame has ceased within a furnace, to form a composite signal having a number of different frequencies. It is known that there will be a characteristic frequency in the range of 5 to 15 hz. present only when there is an actual flame existing. By detecting this characteristic frequency, presence of flame can be accurately determined.

In order to extract this characteristic frequency, the voltage signal at point 20 is processed by a series of signal filters 23, 24, and 25, filters 23 and 25 being active filters of the filter-amplifier type and which receive a standard voltage provided by a precision voltage halver 22. Filter-amplifiers 23 and 25 have active elements which are powered by the voltages available from power supply 12 and whose polarities are both positive. This processing is conventional and results in a signal on path 29 which closely conforms to waveform a of FIG. 3. The internal output amplifier 26 shown as a part of filter 25 receives the precision voltage from the voltage-halver 22 through a resistor 31 or path 27. By providing the precision voltage to one input terminal of the output amplifier stage of filter 26, the DC component necessary for proper operation of the converter circuit 11 can be easily created.

Within converter circuit 11 an operational amplifier 36 inverts the input signal. As explained earlier, the term "invert" is here taken to mean that the voltage of the inverted signal is equal at any instant to twice the DC component of the input signal, $2\times4.35$ v. or 8.7 v., less the voltage of the input signal at that instant. Amplifier 36 receives the input signal on its − input terminal through a resistor 35. The precision voltage of 4.35 v. is applied to the +input terminal of amplifier 36. Amplifier 36 receives power for operating from power supply 12. A resistor 37 provides a feedback path from the output terminal of amplifier 37 to its input terminal. The precision voltage input to the+terminal creates the necessary DC component in the output signal of amplifier 36. Resistor 37 is selected to provide substantial linearity in the amplification of amplifier 36 over the range of the input signal, here from about 2.0 v. to 6.5 v.

The input signal in converter circuit 11 is processed in the same way and by similar circuit components. The input signal is applied to a first of the two terminals of capacitor 32. Resistor 40 connects the second of the capacitor 32 terminals to ground. The cathode of diode 45 is connected to the second terminal of capacitor 32 and the cathode of diode 45 is connected to a voltage summing point 47.

The inverted signal is processed in the same manner, with a capacitor 33 connected by a first of its two terminals to the output terminal of amplifier 36 and by the second of its two terminals to ground through resistor 41. A diode 44 has its cathode connected to the second terminal of capacitor 33 and its anode connected to the summing point 47. Both capacitors 32 and 33, resistors 40 and 41 and diodes 44 and 45 should have values as equal as possible. A capacitor 50 has a first terminal connected to summing point 47 by resistor 48, and a second terminal connected to ground. Diodes 44 and 45 along with resistor 48 form the full wave equivalent of the diode circuit of FIGS. 1 and 2. I prefer the value of resistor 48 to have an order of magnitude approximately two times smaller than that of resistor 40 or 41 to assure that the major portion of the charge formed on capacitors 32 and 33 is transferred to capacitor 50. At the same time, the value of resistors 40 and 41 should be small enough to discharge capacitors 32 and 33 relatively quickly if amplitude of waveform a shrinks. The output signal is provided as a negative current through resistor 56 to an output terminal 58. A low impedance load 51 connected between terminal 58 and ground receives the output signal and also provides a discharge path for capacitor 50 in a manner congruent with that explained for the circuit of FIG. 1.

Operation of the converter circuit 11 of FIG. 4 is essentially the same as for the circuits of FIGS. 1 and 2. Capacitors 32 and 33 quickly charge to the DC component value of 4.35 v. When the low frequency periodic input signal indicative of flame is present, capacitors 32 and 33 have their second terminals driven to below ground on the less positive half cycles of the input and inverted signals respectively. The voltage at summing point 47 is thus continuously driven negative when the 5–15 hz. frequency characteristic of flame is present in the signal at point 20, and capacitor 50 charges so that its first terminal is negative. This charge is constantly bled by the discharge path of resistor 56 and load 51, and replenished by current supplied by capacitors 32 and 33. When the periodic component of the signal on path 29 vanishes, the current to charge capacitor 50 is no longer replenished and the voltage at the first terminal of capacitor 50 rises to near zero. The load 51 senses this change in the magnitude of current flow through terminal 58 and will typically respond by shutting a fuel valve or taking some other safety-related action. It is intended that the load 51 comprise the circuit described in my co-pending application entitled "Fail-Safe Condition Sensing Circuit", although there are obviously other possible candidates for load 51 as well.

There was earlier mention made of the output of the level shift detector 19 on path 21. The voltage on path 21 rises abruptly should flame be detected to have suddenly been extinguished. The voltage on path 21 is conducted to terminal 58 through a diode circuit comprising a series connected resistor 53 and a diode 54. Such a sudden rise in voltage on path 21 will cause the voltage on terminal 58 to rise toward 0 v. as well, simulating loss of the periodic voltage amplitude on path 29. In this way, either of the two conditions indicating loss of flame will cause a rise in the voltage on terminal 58 which may be used by the load to close a valve or take other activities required by the no flame condition.

The preceding discussion has to some extent emphasized the function of simulating a flame rod output with an infrared detector. There is the equally important factor of using for safety critical functions, circuitry which produces an output signal of one polarity in response to an input signal of the opposite polarity and while powered from a source of the same opposite polarity. The reader should therefore expect that the designs described above show only what is for my application the more convenient orientation of the polarities. It is likely that some applications may in the future use the opposite orientation for the polarities. This means that the diode orientation throughout the circuits will be reversed in order to be compatible with this reversed polarity. There will certainly be other variations on this invention as well, all of which will fall within its spirit and which I wish to include within the scope of the claims which follow.

The preceding has described my invention. What I wish to claim is:

1. A converter circuit for providing an output signal of a first polarity responsive to a periodic low frequency input signal varying between two voltage limit values of a second polarity different from the first polarity, comprising:

a) a first capacitor having a first of two terminals connected to receive the input signal;

b) an inverting amplifier receiving the input signal and providing a signal varying between the voltage limit values, and inverted with respect to the input signal;

c) a second capacitor having a first of two terminals connected to receive the inverting amplifier output;

d) first and second resistors connecting second terminals of the first and second capacitors respectively to ground;

e) first and second diodes having first terminals connected together, with the second terminals connected respectively to the second terminals of the first and second capacitors, said diodes oriented for back biasing by the input signal and the inverted signal;

f) a third resistor having a first of two terminals connected to the first and second diodes, first terminals;

g) a third capacitor connected between ground and a second terminal of the third resistor and providing the signal at the third resistor's second terminal; and h) a resistive path connected to discharge the third capacitor.

2. The circuit of claim 1, wherein the inverting amplifier comprises an operational amplifier having first and second input terminals and receiving a fixed voltage level falling between the voltage limit values on the first terminal, and the input signal on the second terminal.

3. The circuit of claim 1, wherein the first and second capacitors have equal values.

4. The circuit of claim 3, wherein the first and second capacitor value is smaller than the value of the third capacitor.

5. The circuit of claim 3, wherein the first and second resistors have equal values.

6. The circuit of claim 1, wherein the first and second resistors have equal values.

7. The circuit of claim 6, including a fourth resistor having a first terminal connected to the second terminal of the third resistor and providing the output signal on a second terminal.

8. The circuit of claim 1, including a voltage source, an infrared-sensitive cell having a first of two terminals connected to a first terminal of the voltage source, a fourth resistor connecting the second of the cell's terminals to a second terminal of the voltage source, a level shift detector sensing the voltage across the fourth resistor, and providing an output signal voltage which has the first polarity responsive to a steady state voltage across the fourth resistor and the second polarity otherwise, and a second diode circuit comprising a diode and a resistor in series connection conducting the output signal from the level shift detector to the third resistor's second terminal, said second diode circuit's diode oriented to be back biased by an output signal voltage of the first polarity from the level shift detector.

9. The circuit of claim 1, wherein the diodes, first terminals are anodes, and wherein the voltage limit values polarity is positive.

10. The circuit of claim 9, wherein the first and second capacitors have equal values.

11. The circuit of claim 10, wherein the first and second capacitor value is smaller than the value of the third capacitor.

12. The circuit of claim 11, wherein the first and second resistors have equal values.

13. The circuit of claim 11, wherein the value of the third resistor is approximately two order of magnitude less than the values of the first and second resistors.

14. A circuit for providing an output signal of a first polarity responsive to a low frequency input signal varying between first and second voltage limit values both having polarity differing from that of the output signal, comprising:

a) a first capacitor having a first of two terminals connected to receive the input signal;

b) a first resistor connecting a second of the first capacitor's two terminals to ground;

c) a diode circuit comprising a diode and a second resistor in series connection, said diode circuit having a first of two terminals connected to the second terminal of the first capacitor, said diode oriented in the diode circuit for back biasing by the input signal;

d) a second capacitor connected between ground and a second terminal of the diode circuit; and e) a resistive path connected to discharge the second capacitor, wherein the output signal arises from current drawn from the second capacitor.

15. The circuit of claim 14, wherein the output signal polarity is negative and the voltage limit values are positive, and wherein the diode circuit's first terminal is connected to the diode's cathode.

16. The circuit of claim 14, wherein the resistance in the resistive path has a magnitude approximately that of the first resistor.

17. The circuit of claim 14, wherein the resistive path comprises a third resistor connected in parallel with the second capacitor.

18. The circuit of claim 17, wherein the value of the third resistor is approximately two orders of magnitude less than the value of the first resistor.

19. The circuit of claim 18, wherein the resistive path comprises a third resistor connected in parallel with the diode.

20. The circuit of claim 14, wherein the value of the third resistor is approximately two orders of magnitude less than the value of the first resistor.

* * * * *